US006250422B1

(12) United States Patent
Goplen et al.

(10) Patent No.: US 6,250,422 B1
(45) **Date of Patent: *Jun. 26, 2001**

(54) DUAL CROSS-FLOW MUFFLER

(75) Inventors: Gary D. Goplen; Jeffrey L. Peterson, both of Stoughton; Kory J. Schuhmacher, Oregon, all of WI (US)

(73) Assignee: Nelson Industries, Inc., Stoughton, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/436,576

(22) Filed: Nov. 9, 1999

Related U.S. Application Data

(63) Continuation-in-part of application No. 09/211,683, filed on Dec. 14, 1998, now Pat. No. 6,076,632.

(51) Int. Cl.[7] ..... F01N 1/08
(52) U.S. Cl. ..... 181/272; 181/282
(58) Field of Search ..... 181/250, 255, 181/264, 265, 266, 269, 272, 273, 276, 282

(56) References Cited

U.S. PATENT DOCUMENTS

| | | | |
|---|---|---|---|
| 2,975,854 | 3/1961 | Bakke et al. . | |
| 3,378,099 | 4/1968 | Gordon . | |
| 3,404,749 | 10/1968 | Miller et al. . | |
| 3,709,320 | 1/1973 | Hollerl et al. . | |
| 3,863,734 | 2/1975 | Pawlina . | |
| 4,164,989 | 8/1979 | Lux et al. . | |
| 4,165,798 | 8/1979 | Martinez . | |
| 4,415,059 | 11/1983 | Hayashi | 181/250 |
| 4,700,806 | 10/1987 | Harwood . | |
| 4,736,817 | 4/1988 | Harwood . | |
| 4,741,411 | 5/1988 | Stricker . | |
| 4,759,423 | 7/1988 | Harwood et al. . | |

(List continued on next page.)

*Primary Examiner*—Khanh Dang
(74) *Attorney, Agent, or Firm*—Andrus, Sceales, Starke & Sawall, LLP

(57) ABSTRACT

A muffler includes an upstream outer shell, a downstream outer shell, and identical upstream and downstream inner baffles forming in combination an upstream expansion chamber, an inner expansion chamber, and a downstream expansion chamber. The upstream and downstream inner baffles divide the inner expansion chamber therebetween into a main chamber and first and second laterally spaced subchambers. The upstream and downstream inner baffles have respective sets of apertures therethrough laterally offset from each other and aligned with respective subchambers and communicating exhaust from the upstream expansion chamber through the set of apertures in the upstream inner baffle into the first subchamber and then flowing laterally through the main chamber to the second subchamber and then flowing through the second set of apertures into the downstream expansion chamber. Each of the upstream and downstream inner baffles has a second set of apertures and drawn portions providing an oppositely directed bypass flow passage relieving backpressure.

16 Claims, 10 Drawing Sheets

U.S. PATENT DOCUMENTS

| | | |
|---|---|---|
| 4,765,437 | 8/1988 | Harwood et al. . |
| 4,766,983 | 8/1988 | Tamba et al. . |
| 4,809,812 | 3/1989 | Flugger . |
| 4,821,840 | 4/1989 | Harwood et al. . |
| 4,836,330 | 6/1989 | Harwood et al. . |
| 4,847,965 | 7/1989 | Harwood et al. . |
| 4,860,853 | 8/1989 | Moring, III . |
| 4,865,154 | 9/1989 | Hanson et al. . |
| 4,894,987 | 1/1990 | Harwood et al. . |
| 4,901,815 | 2/1990 | Harwood et al. . |
| 4,909,348 | 3/1990 | Harwood et al. . |
| 4,924,968 | 5/1990 | Moring, III et al. . |
| 4,928,372 | 5/1990 | Harwood et al. . |
| 4,941,545 | 7/1990 | Wilcox et al. . |
| 4,958,701 | 9/1990 | Moring, III . |
| 4,972,921 | 11/1990 | Takada et al. . |
| 5,004,069 | 4/1991 | Van Blaircum et al. . |
| 5,042,125 | 8/1991 | Harwood et al. . |
| 5,147,987 | 9/1992 | Richardson et al. . |
| 5,164,551 | 11/1992 | Harwood et al. . |
| 5,173,577 | 12/1992 | Clegg et al. . |
| 5,229,557 | 7/1993 | Allman et al. . |
| 5,252,788 | 10/1993 | Emrick et al. . |
| 5,315,075 | 5/1994 | Junginger et al. . |
| 5,326,943 | 7/1994 | Macaulay . |
| 5,327,722 | 7/1994 | Clegg et al. . |
| 5,428,194 | 6/1995 | Emrick et al. . |
| 5,448,831 | 9/1995 | Harwood . |
| 5,473,891 | 12/1995 | Baxter et al. . |
| 5,504,280 | 4/1996 | Woods . |
| 5,563,383 | 10/1996 | Harwood . |
| 5,563,385 | 10/1996 | Harwood . |
| 5,581,056 | 12/1996 | Bellgardt et al. . |
| 5,597,986 | 1/1997 | Harwood et al. . |
| 5,717,173 | 2/1998 | Gerber et al. . |
| 5,773,770 | 6/1998 | Jones . |
| 5,859,394 | 1/1999 | Seehaus et al. . |

FIG. 14
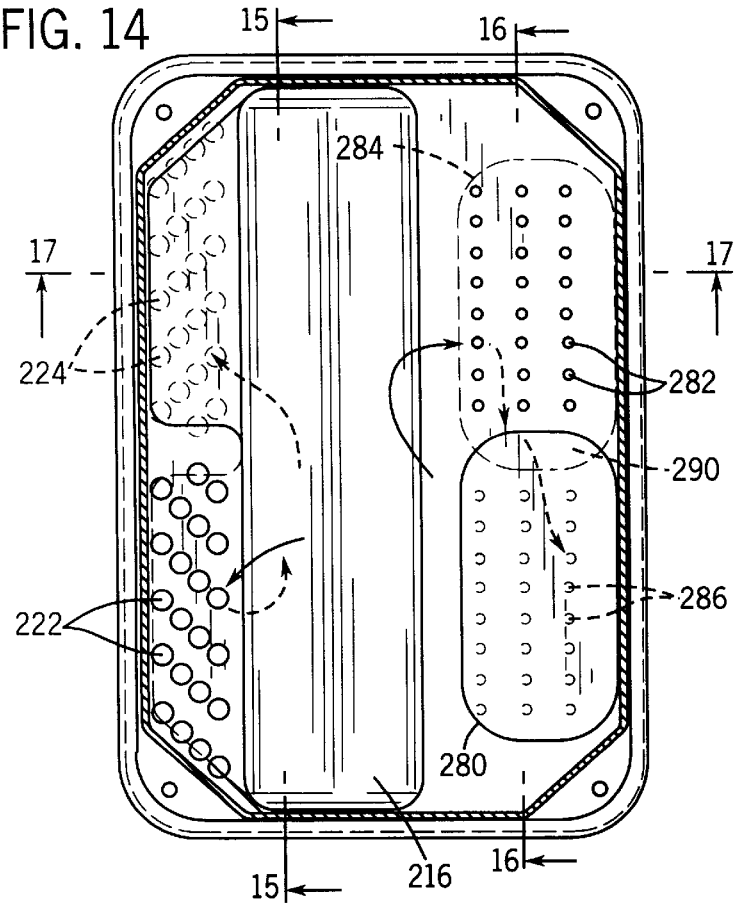
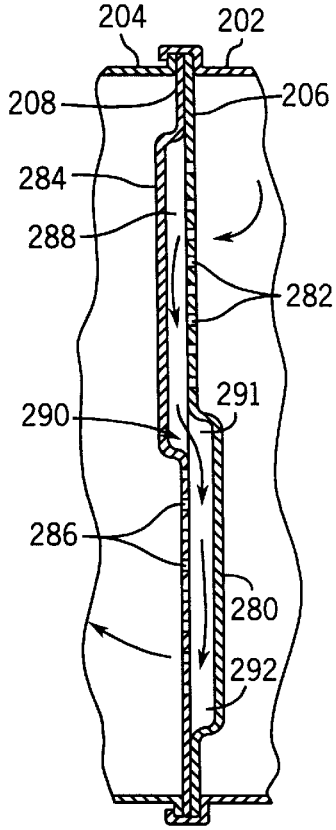
FIG. 16
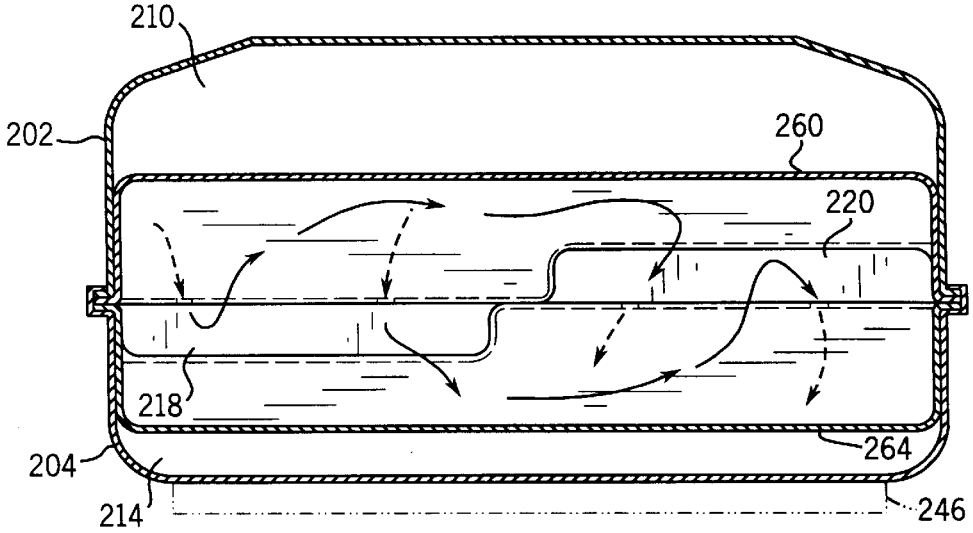
FIG. 15

FIG. 17
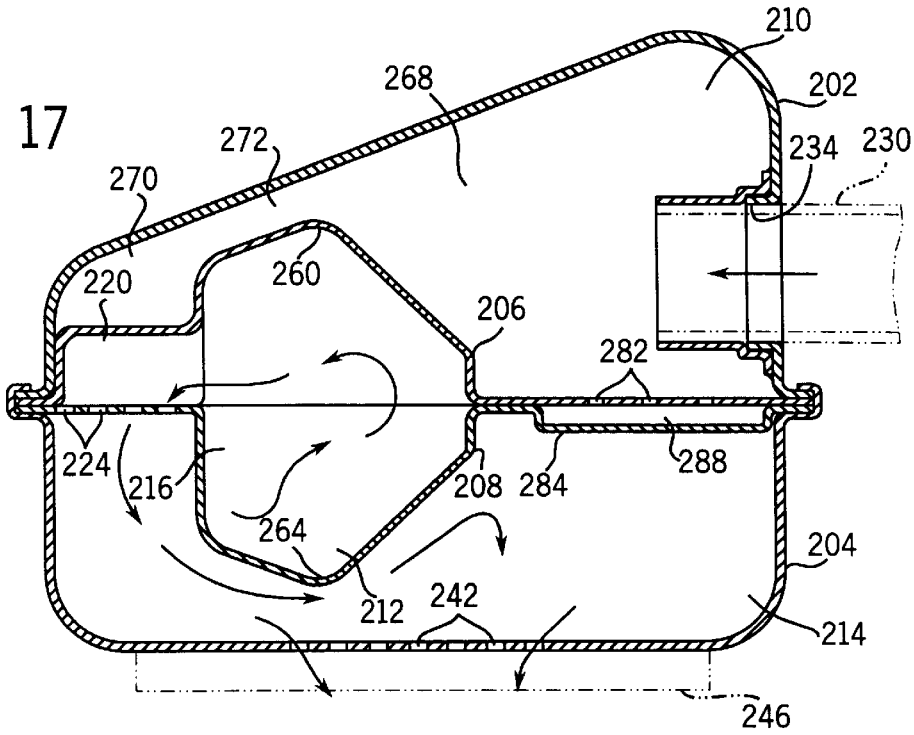
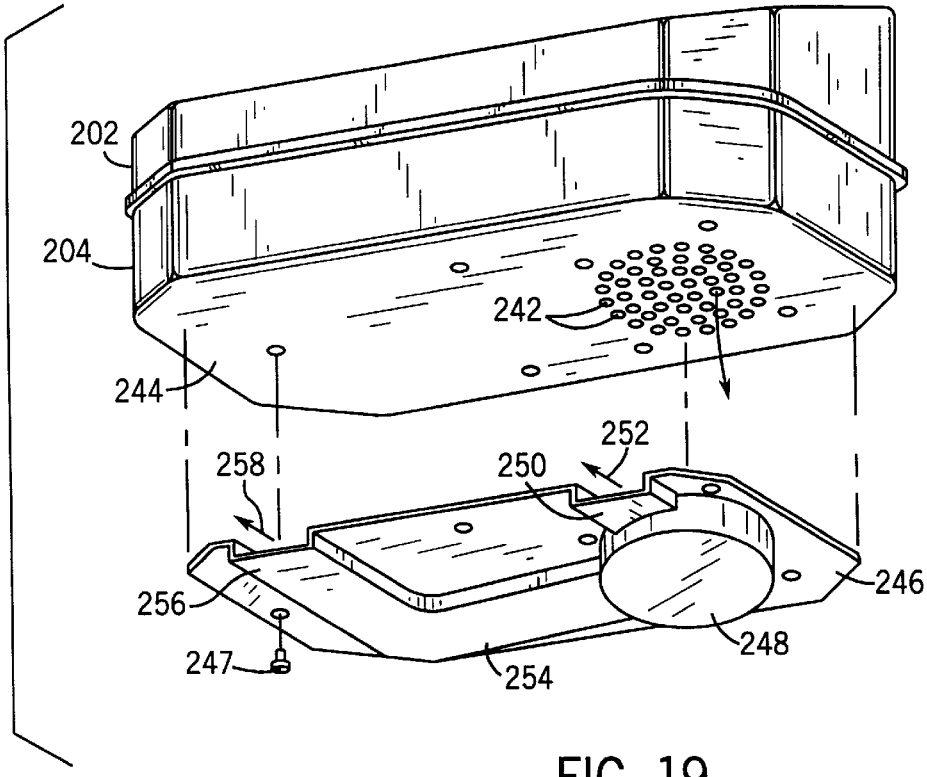
FIG. 19

FIG. 20
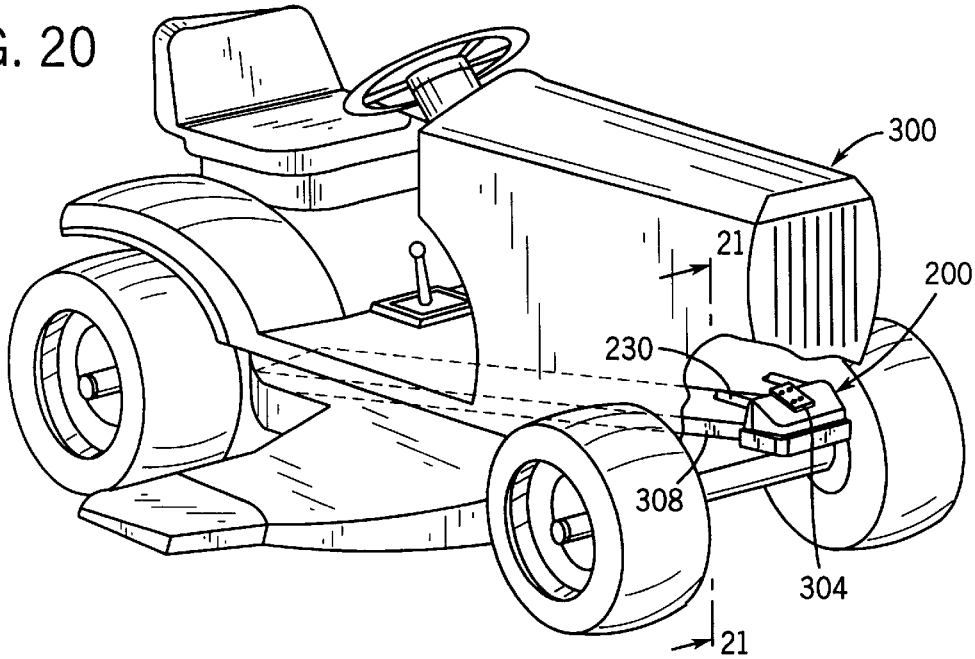
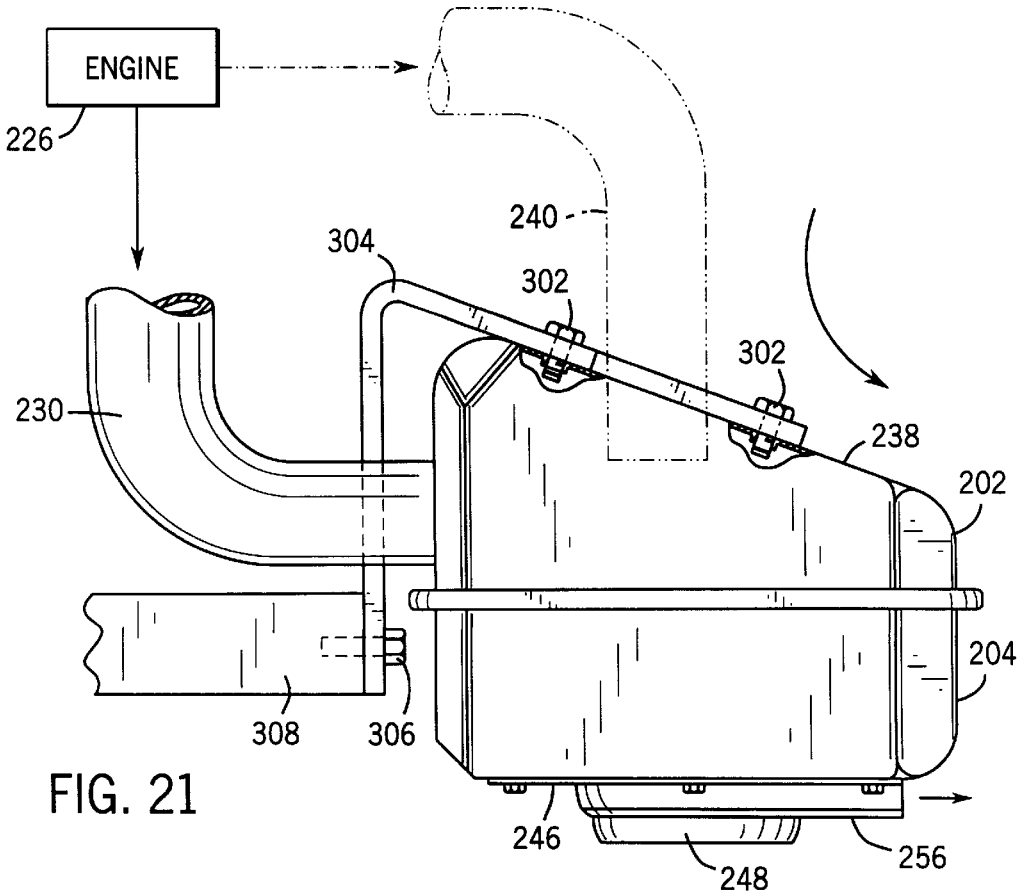
FIG. 21

DUAL CROSS-FLOW MUFFLER

CROSS REFERENCE TO RELATED APPLICATION

This application is a continuation-in-part of U.S. application Ser. No. 09/211,683, filed Dec. 14,1998 now U.S. Pat. No. 6,076,632.

BACKGROUND OF THE INVENTION

The invention relates to noise-silencing mufflers.

The invention arose during continuing muffler development efforts, including further development efforts directed to the subject matter of the noted parent application.

The invention of the noted parent application arose during muffler development efforts, including those directed to solving problems in box-style mufflers, including muffler shell noise and poor muffler silencing. Since cost is almost always a concern, the solution to the two noted problems must also be cost effective. Box-style or stamped mufflers tend to radiate noise from their flat exterior surfaces. This characteristic is called shell noise and is most often a concern because of its harsh sound and adverse effects on muffler silencing. Also of concern with stamped mufflers is overall acoustic effectiveness. Because these types of mufflers are often constrained to a certain size and shape, their physical layout is not always conducive to good silencing.

The invention of the parent application addresses and solves the noted problems in a particularly cost effective manner using a simple design. In one aspect, the parent invention enables usage of identical parts within the muffler, which improves manufacturing efficiency and provides a cost reduction. Assembly of the muffler is also easy because the majority of the muffler's internal parts are designed into cross flow baffles. In accordance with the preferred embodiment, to combat the shell noise problem, the flow from the inlet is directed into one of two interior chambers of the muffler, formed by placing two of the cross flow baffles back to back. By letting the exhaust expand first in an interior chamber, the pressure pulses from the engine are less likely to cause exterior noise problems since they are damped considerably before reaching the muffler's outer shells. Stiffening bosses may be provided on larger flat areas of the baffles to control internal shell noise. To increase silencing capability, four chambers are created within the muffler by using a twin baffle design, along with two additional volumes between the outer shells and baffles. In one aspect, a horseshoe-shaped cross flow baffle is designed to provide the twin internal silencing chambers with desired flow path and area between them. The configuration increases the acoustical effectiveness of the muffler.

The present invention provides further improvements in both performance and lowered cost. The muffler design of the present invention provides optimization for the majority of small engine applications. In the preferred embodiment, as in the parent application, cost reduction is facilitated by the use of identical internal components. Performance gains are enabled by alternate flow routes designed into paired baffles, together with increased expansion chamber volume conducive to better silencing characteristics. The internal baffles divide respective chambers between themselves into a main chamber and subchambers and have respective sets of slots or apertures offset from each other and aligned with a respective subchamber. The offset forces the exhaust to turn as it travels into and out of the main chamber, enhancing acoustic silencing. Each baffle has a drawn center area dividing the volume between the outer shells of the muffler and the center chamber, allowing for more expansion and contraction of exhaust gas, enhancing acoustic silencing. An area between the top shell and the inner baffle provides a flow path forcing hot exhaust gas toward the surface of the top shell, enhancing cooling of the exhaust flow. The large surface area of the body helps minimize afterfiring, which is an undesirable bang or pop prevalent in small engines at shut down. Smaller drawn areas in the baffles provide additional chambers affording an alternate flow path for exhaust gas, lowering backpressure. The top shell is sloped for shedding debris, such as grass and dirt, which is desirable for lawn tractor applications.

BRIEF DESCRIPTION OF THE DRAWINGS

PARENT APPLICATION

Figure 1:
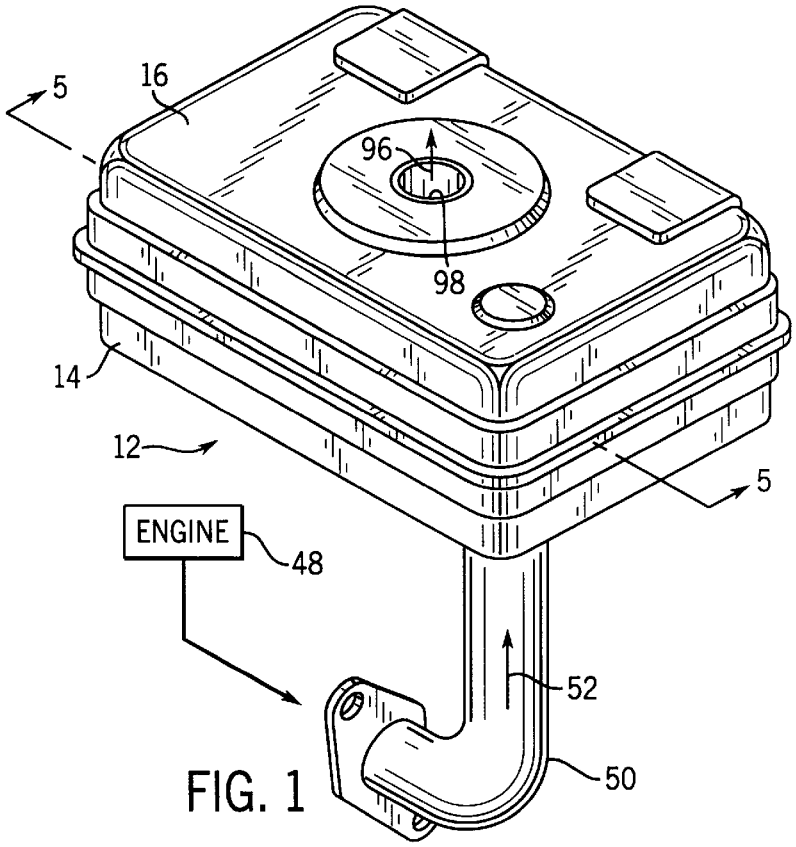

FIG. 1 is an isometric elevational view of a muffler constructed in accordance with the invention of the noted parent application.

Figure 2:
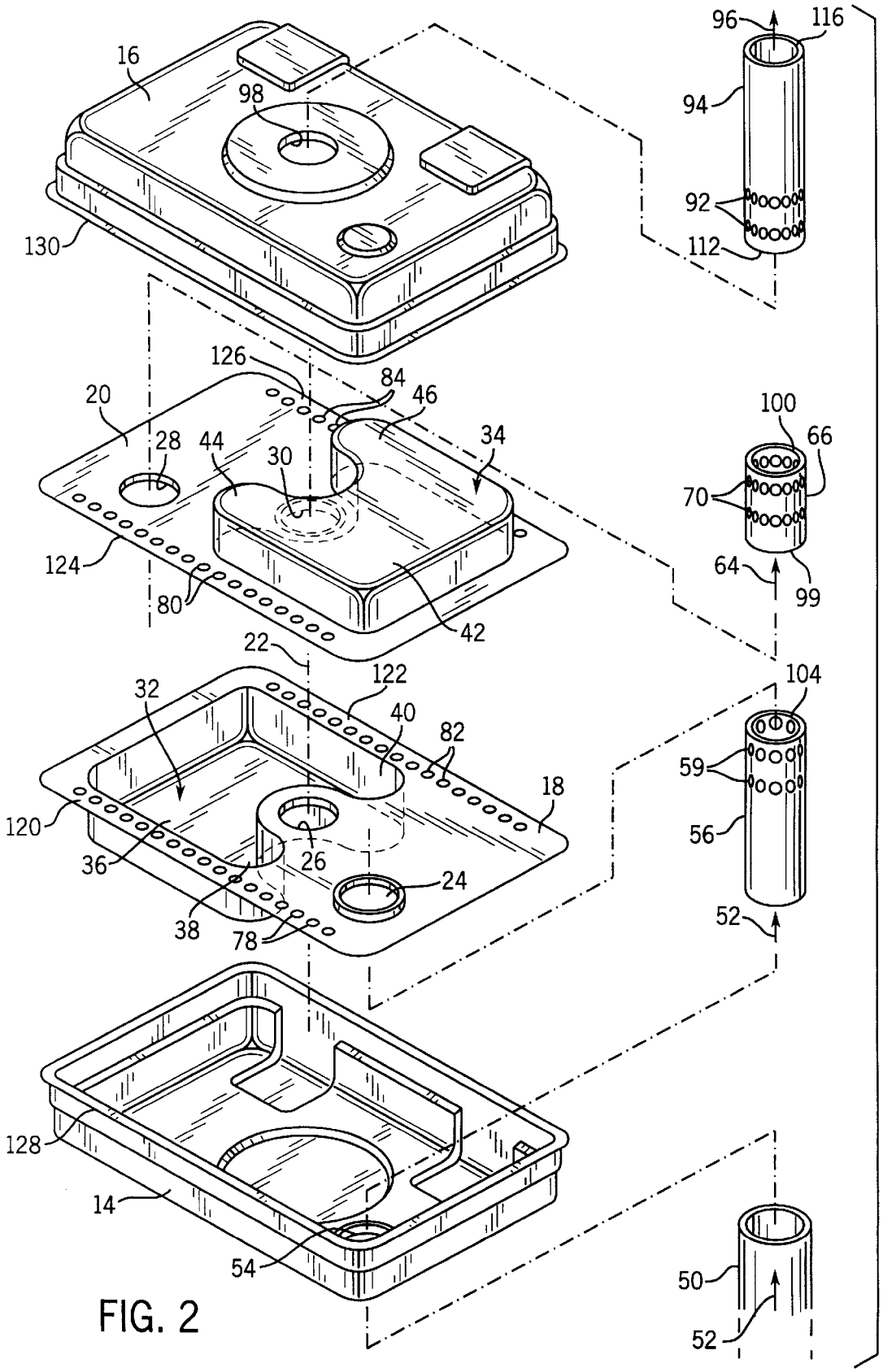

FIG. 2 is an exploded perspective view of the structure of FIG. 1.

Figure 3:
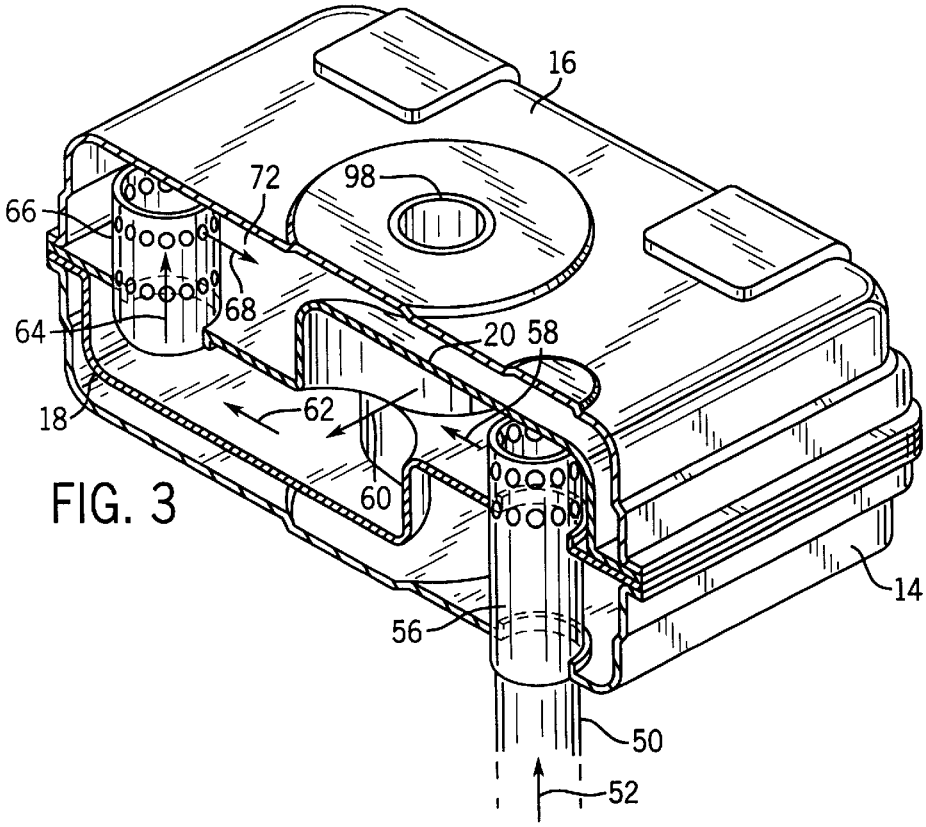

FIG. 3 is a view like FIG. 1, partially cut away.

Figure 4:
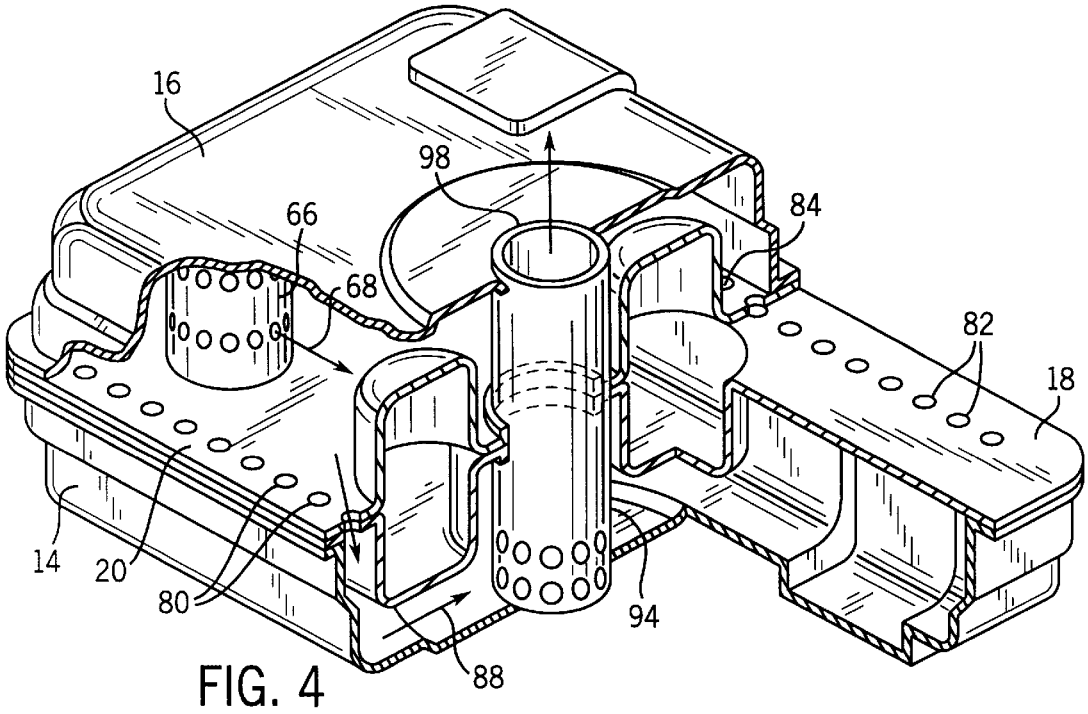

FIG. 4 is another view like FIG. 1, partially cut away.

Figure 5:
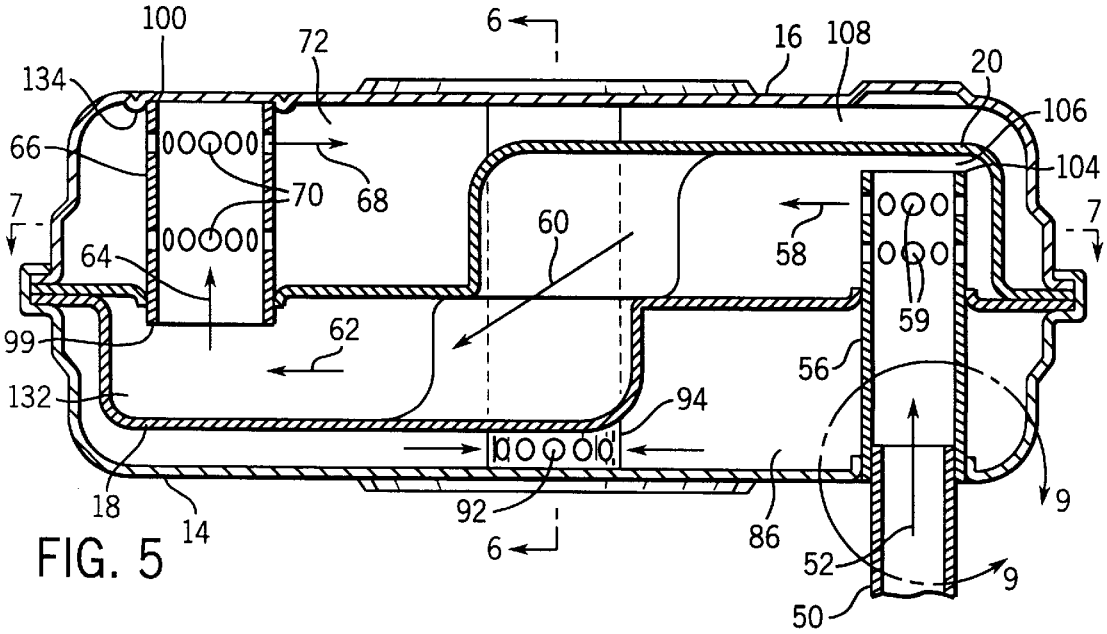

FIG. 5 is a sectional view taken along line 5—5 of FIG. 1.

Figure 6:
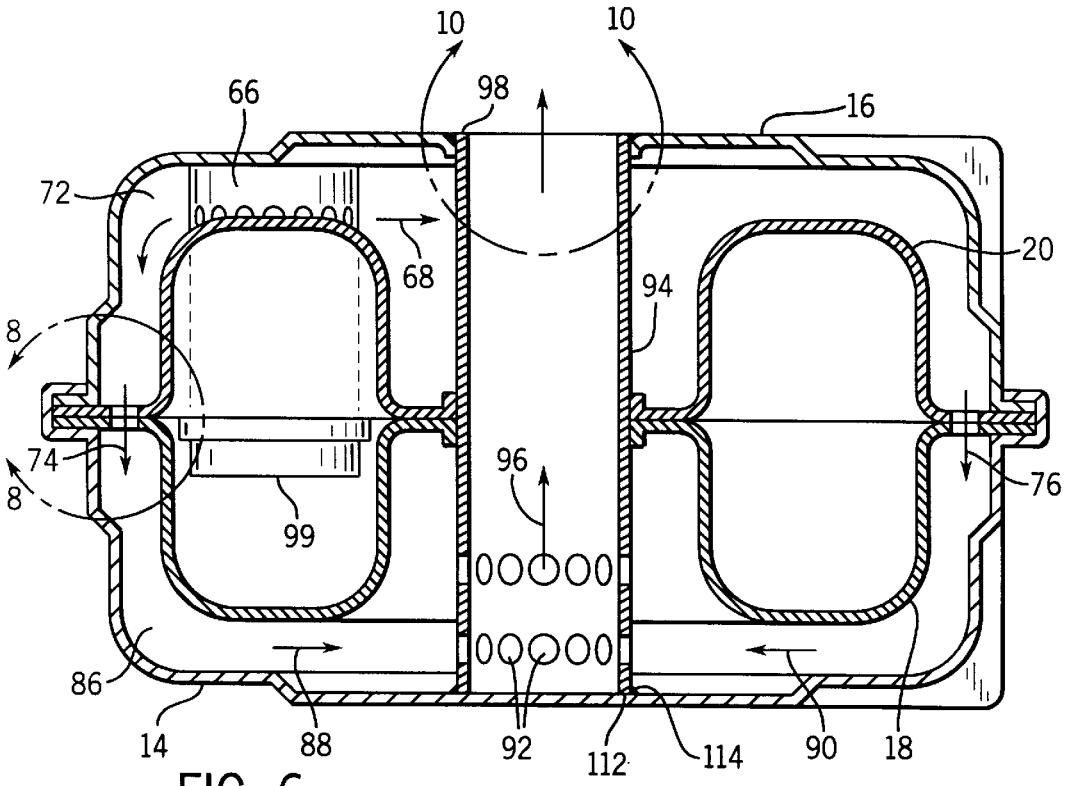

FIG. 6 is a sectional view taken along line 6—6 of FIG. 5.

Figure 7:
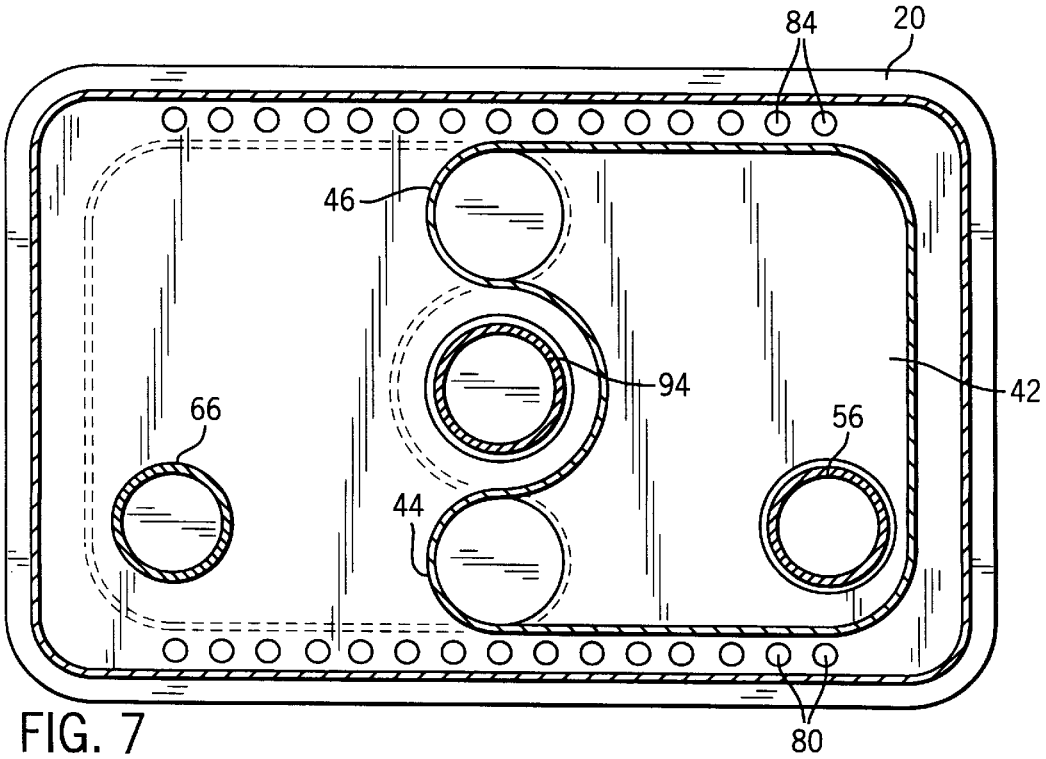

FIG. 7 is a sectional view taken along line 7—7 of FIG. 5.

Figure 8:
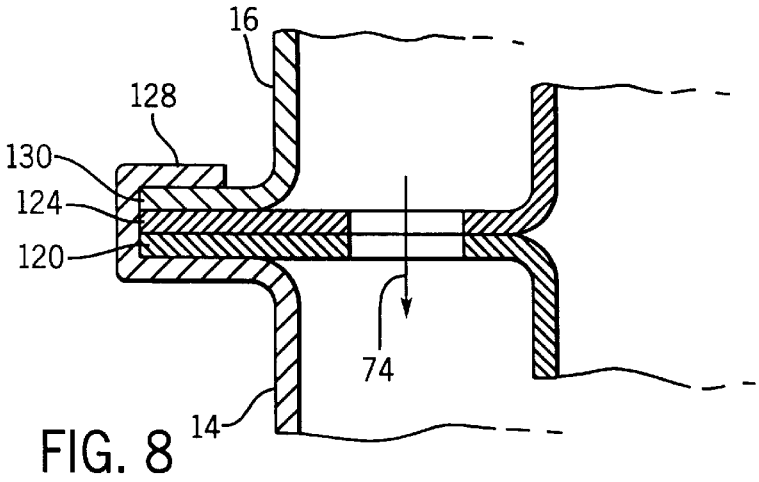

FIG. 8 is a sectional view taken along line 8—8 of FIG. 6.

Figure 9:
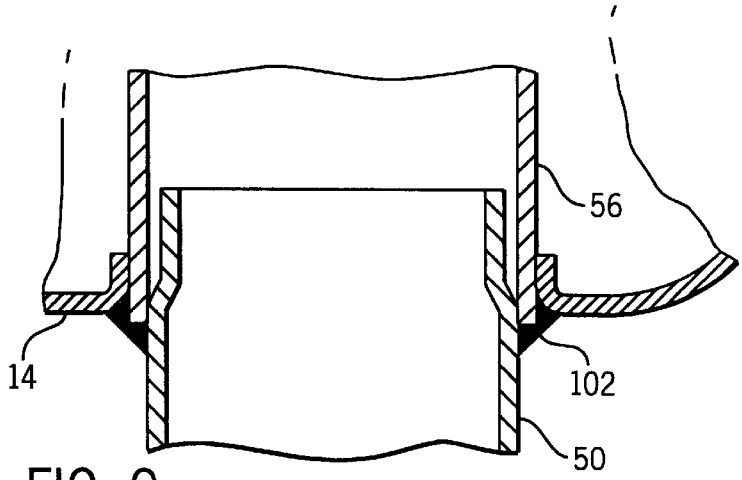

FIG. 9 is a sectional view taken along line 9—9 of FIG. 5.

Figure 10:
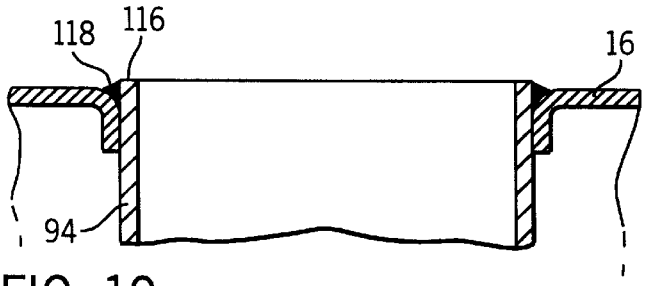

FIG. 10 is a sectional view taken alone line 10—10 of FIG. 6.

PRESENT INVENTION

Figure 11:
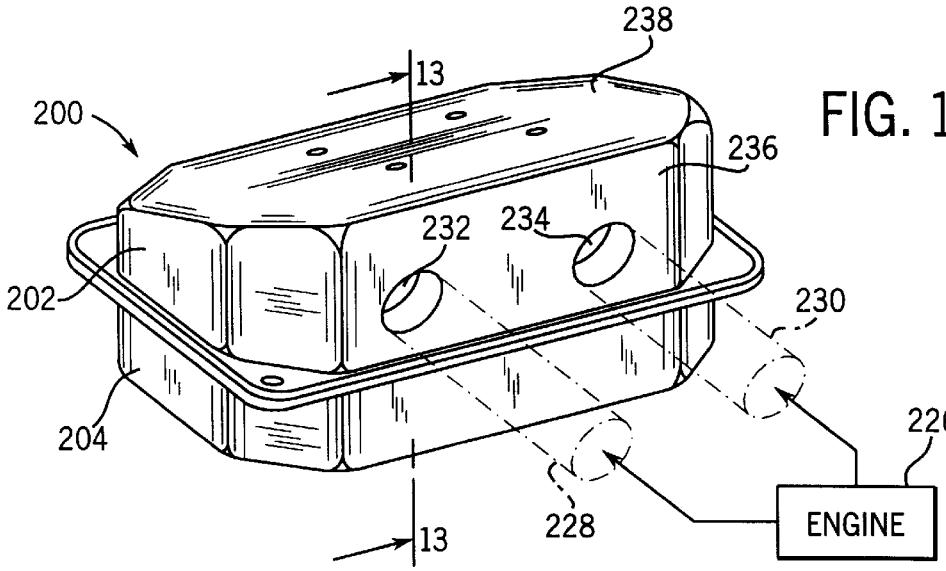

FIG. 11 is an isometric elevational view of a muffler constructed in accordance with the present invention.

Figure 12:
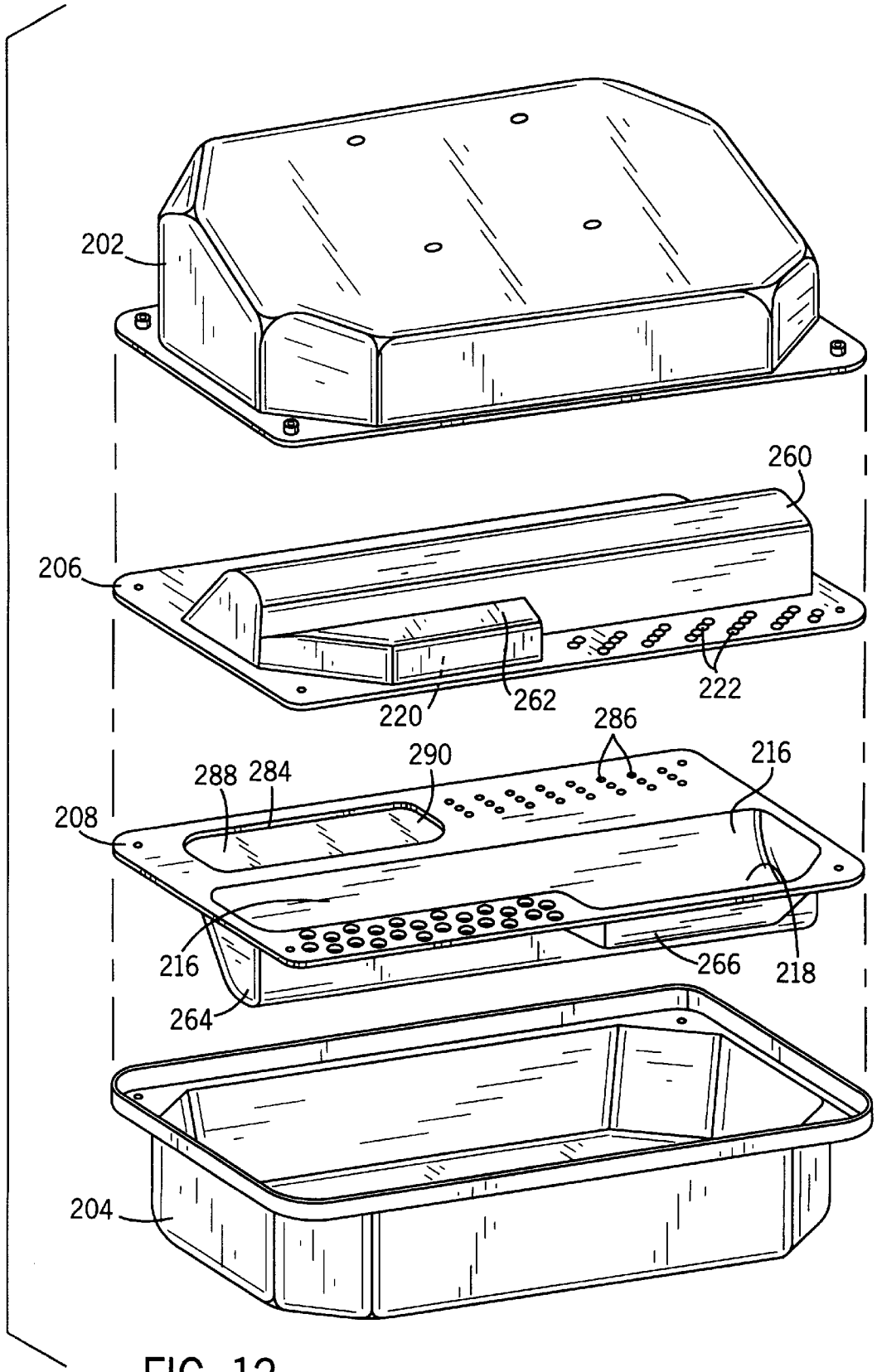

FIG. 12 is an exploded perspective view of the structure of FIG. 11.

Figure 13:
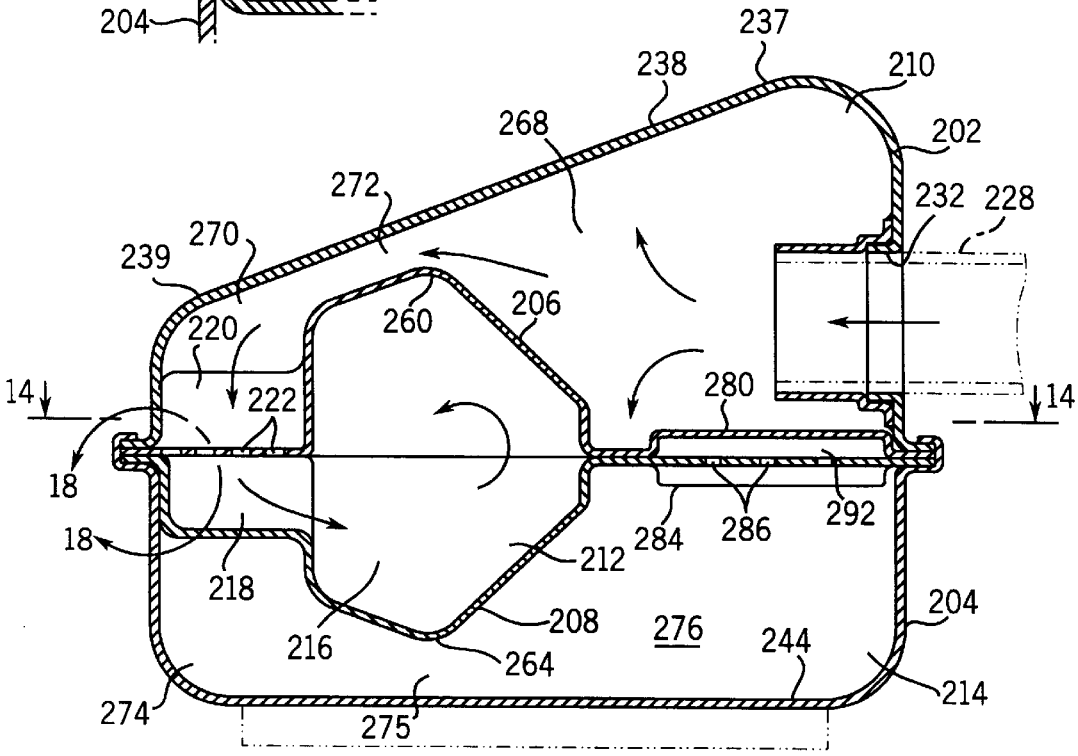

FIG. 13 is a sectional view taken along line 13—13 of FIG. 11.

FIG. 14 is a sectional view taken along line 14—14 of FIG. 13.

FIG. 15 is a sectional view taken along line 15—15 of FIG. 14.

FIG. 16 is a sectional view taken along line 16—16 of FIG. 14.

FIG. 17 is a sectional view taken along line 17—17 of FIG. 14.

Figure 18:
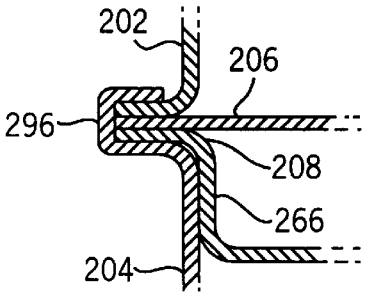

FIG. 18 is an enlarged view of a portion of the structure of FIG. 13 as shown at line 18—18.

FIG. 19 is a bottom isometric elevational view of the muffler of FIG. 11 and showing an additional bottom exhaust directive plate.

FIG. 20 shows one application of the present invention on a lawn tractor.

FIG. 21 is a view taken along line 21—21 of FIG. 20.

DETAILED DESCRIPTION OF THE INVENTION

PARENT APPLICATION

FIG. 1 shows a muffler 12, FIG. 1, have first and second outer shell members 14 and 16, FIG. 2, and first and second inner baffle members 18 and 20. Inner baffle members 18 and 20 are identical to each other and extend parallel to each other in mirror image relation and rotated 180° relative to each other about an axis 22 perpendicular to such parallel extension. Inner baffle member 18 has first and second exhaust passages 24 and 26 therethrough. Inner baffle member 20 has first and second exhaust passages 28 and 30 therethrough. Exhaust passage 26 through inner baffle 18 is aligned with exhaust passage 30 through inner baffle member 20 along axis 22. Exhaust passages 24 and 28 are laterally offset from each other and from exhaust passages 26, 30. Each of the inner baffle members 18, 20 has an expansion chamber 32, 34, respectively. Exhaust passage 24 through inner baffle member 18 opens into expansion chamber 34 of inner baffle member 20. Exhaust passage 28 through inner baffle member 20 opens into expansion chamber 32 of inner baffle member 18.

Expansion chambers 32, 34 are formed in respective baffle members 18, 20 during stamping, preferably by known deep draw cold forming, and have portions laterally offset from each other, and have portions partially overlapped to provide exhaust flow communication therebetween. Exhaust flow passages 26, 30 are laterally offset from each of the expansion chambers. Expansion chamber 32 is horseshoe-shaped and has a central bight 36 and a pair of spaced arms 38 and 40 extending therefrom. Expansion chamber 34 is a identical and is horseshoe-shaped and has a central bight 42 and a pair of spaced arms 44 and 46 extending therefrom. Exhaust passages 26, 30 extend between the spaced arms 38 and 40, and 44 and 46 of each expansion chamber 32 and 34, respectively. Spaced arms 38 and 40 of expansion chamber 32 are overlapped respectively with spaced arms 44 and 46 of expansion chamber 34.

Exhaust from an internal combustion engine 48, FIG. 1, flows through its exhaust outlet pipe 50 into muffler 12. The exhaust flow path extends axially forwardly, which is upwardly as shown at arrow 52 in FIGS. 1–3 and 5, through opening 54 in outer shell number 14 then along inlet exhaust tube 56 through exhaust passage 24 through inner baffle member 18 into expansion chamber 34 of inner baffle member 20 then laterally as shown at arrow 58, FIGS. 3 and 5, through apertures 59 in inlet exhaust tube 56, through expansion chamber 34 into spaced parallel arms 44, 46 then axially rearwardly and laterally as shown at arrow 60 through spaced arms 44, 46 into spaced arms 38, 40 of expansion chamber 32 of baffle member 18 then laterally in expansion chamber 32 as shown at arrow 62 then axially forwardly as shown at arrow 64 along internal transfer tube 66 through exhaust passage 28 through inner baffle member 20 then laterally as shown at arrow 68 through apertures 70 in internal transfer tube 66 into a chamber 72 between inner baffle member 20 and outer shell member 16 then axially rearwardly as shown at arrows 74 and 76, FIG. 6, FIGS. 6 and 8, through inner baffle members 20 and 18 through a plurality of sets of aligned apertures 78 and 80, and 82 and 84, FIG. 2, along peripheral portions of the inner baffle members then into a chamber 86, FIGS. 5 and 6, between inner baffle member 18 and outer shell member 14 then laterally through chamber 86 as shown at arrows 88, 90, FIG. 6, through apertures 92 in outlet exhaust tube 94 then axially forwardly as shown at arrow 96 through exhaust outlet tube 94 through exhaust passages 26, 30 through inner baffle members 18, 20, respectively, and through opening 98 in outer shell member 16. The axially rearward, downward in FIGS. 1–6, exhaust flow from expansion chamber 34 of inner baffle member 20 is split into spaced parallel paths, namely a first path through arms 46 and 40, and a second path through arms 44 and 38. The exhaust flow path extending axially forwardly, upwardly in FIGS. 1–6, through inner baffle members 18 and 20 from chamber 86 extends between and parallel to such spaced parallel paths and in opposite flow direction relative thereto. Inlet exhaust tube 56 extends axially through outer shell member 14 and inner baffle member 18 and terminates in expansion chamber 34 of inner baffle member 20. Outlet exhaust tube 94 extends axially through outer shell member 16 and inner baffle members 20 and 18 and terminates in chamber 86. Internal transfer tube 66 extends axially through inner baffle member 20, and has an upstream end 99 terminating in expansion chamber 32 of inner baffle member 18, and has a downstream end 100 terminating in chamber 72. Aligned apertures 80 and 78, and 84 and 82, provide a plurality of exhaust flow passages extending axially rearwardly from chamber 72 to chamber 86, arrows 74 and 76, FIG. 6, parallel to outlet exhaust tube 94 and conducting exhaust flow in the opposite direction relative thereto. Expansion chambers 34 and 32 overlap at the noted pair of portions, namely a first portion through arms 46 and 40, and a second portion through arms 44 and 38, which portions are laterally spaced on opposite sides of outlet exhaust tube 94.

Inlet exhaust tube 56 conducts exhaust flow axially forwardly into the muffler as shown at arrow 52. Inlet exhaust tube 56 and exhaust pipe 50 are preferably welded to outer shell 14, as shown at weldment 102, FIG. 9, or alternatively by mechanical crimping, or other various known attachment techniques. Inlet exhaust tube 56 extends through outer shell member 14 at opening 54 and though inner baffle member 18 at passage 24 and has an inner end 104 facing inner baffle member 20 in expansion chamber 34. Inner end 104 is preferably spaced by a small gap 106, FIG. 5, from inner baffle member 20. In an alternate embodiment, inner end 104 engages inner baffle member 20 in expansion chamber 34 with no gap 106 therebetween. Inner baffle member 20 is axially between inner end 104 of inlet exhaust tube 56 and outer shell member 16. There is a gap 108 between outer shell member 16 and inner baffle member 20 at expansion chamber 34, which gap 108 forms part of chamber 72. Outlet exhaust tube 94 conducts exhaust flow axially out of the muffler as shown at arrow 96. Outlet exhaust tube 94 extends through outer shell member 16 at opening 98 and through inner baffle members 20 and 18 at passages 30 and 26, respectively, and has an inner end 112 facing outer shell member 14 and preferably engaging outer shell member 14 and welded thereto at weldment 114, FIG. 6, or other affixment. Outer end 116 of outlet exhaust tube 94 is affixed to outer shell member 16 at weldment 118, FIG. 10, or other affixment. Inlet exhaust tube 56 and outlet exhaust tube 94 conduct exhaust flow in the same axial direction, namely axially forwardly, which is upwardly in the drawings, as shown at respective arrows 52 and 96. Inlet exhaust tube 56 conducts exhaust flow axially forwardly into muffler 12 as shown at arrow 52. Outlet exhaust tube 94 conducts exhaust flow axially forwardly out of the muffler as shown at arrow 96. Outer peripheral flanges 120 and 122 of inner baffle member 18, and outer peripheral flanges 124 and 126 of inner baffle member 20, have the noted sets of aligned apertures 78, 80, 82, 84 therethrough conducting exhaust flow axially rearwardly therethrough, arrows 74 and 76, FIG. 6, in a direction opposite to the noted axially forward direction. The first set of aligned apertures are provided by apertures 80 and 78 in respective flanges 124 and 120 of respective inner baffle members 20 and 18, and the second set of aligned apertures is provided by apertures 84 and 82 in respective flanges 126 and 122 of respective inner baffle members 20 and 18. The noted outer peripheral flanges are sandwiched between outer shell members 14 and 16, FIGS. 5, 6, 8, and are welded or otherwise affixed to each other. In one embodiment, the upper outer lip 128 of outer shell member 14, FIG. 8, is wrapped around abutting flanges 120, 124, and lower outer lip 130 of outer shell member 16, and pressfit or mechanically crimped thereagainst, or welded, or otherwise affixed. Each of the noted apertures 78, 80, 82, 84 is substantially smaller than each of openings 54, 24, 28, 26, 30, 98 in the noted outer shell members 14, 16 and inner baffle members 18, 20. Internal transfer tube 66 conducts exhaust flow axially forwardly as shown at arrow 64. Internal transfer tube 66 extends through inner baffle member 20 at opening 28. Internal transfer tube 66 has the noted upstream end 99 facing inner baffle member 18 at expansion chamber 32 and spaced therefrom by a gap 132, FIG. 5. Internal transfer tube 66 has the noted downstream and 100 facing outer shell member 16 and preferably engaging same and affixed thereto by mechanical crimping as at 134, or other affixment. Internal transfer tube 66 conducts exhaust flow in the same axial direction as inlet and outlet exhaust tubes 56 and 94.

PRESENT INVENTION

FIG. 11 shows a muffler 200 having an upstream outer shell 202, a downstream outer shell 204, an upstream inner baffle 206, FIG. 12, and a downstream inner baffle 208. The components have, in the orientation of FIGS. 11–13, a vertically axially aligned assembled condition forming in combination an upstream expansion chamber 210, FIG. 13, an inner expansion chamber 212, and a downstream expansion chamber 214. Upstream expansion chamber 210 is formed between upstream outer shell 202 and upstream inner baffle 206. Inner expansion chamber 212 is formed between upstream inner baffle 206 and downstream inner baffle 208. Downstream expansion chamber 214 is formed between downstream inner baffle 208 and downstream outer shell 204.

Upstream inner baffle 206 and downstream inner baffle 208 divide inner expansion chamber 212 therebetween into a main chamber 216, FIGS. 12, 13, 17, and first and second laterally spaced subchambers 218 and 220. Upstream inner baffle 206 has a first set of one or more slots or apertures 222 therethrough. Downstream inner baffle 208 has a first set of one or more slots or apertures 224 therethrough laterally offset from the set of apertures 222. The set of apertures 222 is aligned with subchamber 218 and communicates exhaust from upstream expansion chamber 210 axially downwardly through the set of apertures 222 into subchamber 218. The exhaust flow then turns from subchamber 218 and flows laterally leftwardly in the orientation of FIG. 12 through main chamber 216 and then turns into subchamber 220. The set of apertures 224 is aligned with subchamber 220 and communicates exhaust from subchamber 220 axially downwardly through the set of apertures 224 into downstream expansion chamber 214. Exhaust from engine 226, FIG. 11, flows through exhaust tubes 228 and 230 into the muffler at exhaust inlets 232 and 234 in the sidewall 236 of upstream outer shell 202 such that exhaust flows into upstream expansion chamber 210. Alternatively, exhaust from engine 226 may flow into upstream expansion chamber 210 through top wall 238, as shown in FIG. 21 at exhaust pipe 240 shown in phantom. Exhaust is discharged from the muffler from downstream expansion chamber 214 at a suitable outlet port, an example of which in preferred form is provided by a set of one or more slots or apertures 242, FIG. 19, formed in lower wall 244, which may further have a lower exhaust diverter or directive plate 246 attached thereto by screws such as 247 and receiving discharged exhaust at plenum 248 and directing the exhaust through channel 250 as shown at arrow 252 and also through channels 254 and 256 and discharging the exhaust as shown at arrow 258.

Upstream and downstream inner baffles 206 and 208 are identical to each other and extend to parallel to each other and face each other as mirror images except that they are rotated 180 degrees relative to each other about an axis perpendicular to such parallel extension, such axis being the vertical alignment axis of the components in the orientation of the FIG. 12. Upstream inner baffle 206 has a large drawn portion 260 and a smaller drawn portion 262. Downstream inner baffle 208 likewise has a large drawn portion 264 and a smaller drawn portion 266. Large drawn portions 260 and 264 of the upstream and downstream inner baffles mate with each other to define main chamber 216 of inner expansion chamber 212. Smaller drawn portions 266 and 262 are laterally offset from each other, right-left in the orientation of FIG. 12. Smaller drawn portion 266 of downstream inner baffle 208 mates with upstream inner baffle 206 to define subchamber 218. Smaller drawn portion 262 of upstream inner baffle 206 mates with downstream inner baffle 208 to define subchamber 220. The set of apertures 222 in upstream inner baffle 206 is axially aligned with smaller drawn portion 266 of downstream inner baffle 208 and is laterally rightwardly offset from smaller drawn portion 262 of upstream inner baffle 206 and is laterally forwardly offset from large drawn portion 260 of upstream inner baffle 206. The set of apertures 224 in downstream inner baffle 208 is axially aligned with smaller drawn portion 262 of upstream inner baffle 206 and is laterally leftwardly offset from smaller drawn portion 266 of downstream inner baffle 208 and is laterally forwardly offset from large drawn portion 264 of downstream inner baffle 208.

Large drawn portion 260 of upstream inner baffle 206 extends axially upwardly toward upstream outer shell 202, FIGS. 13 and 17, and divides the volume of upstream expansion chamber 210 into first and second sections 268 and 270 allowing for more expansion and contraction of exhaust in upstream expansion chamber 210. First section 268 has the noted one or more inlets 232, 234 receiving exhaust from engine 226. Second section 270 discharges exhaust to the set of apertures 222 therebelow. The upper portion 237, FIG. 13, of the sloped slanted surface 238 is above first section 268 of upstream expansion chamber 210. The lower portion 239 of slanted surface 238 is above second portion 270 of upstream expansion chamber 210 and above subchambers 218 and 220. Sections 268 and 270 are joined by a smaller area connection passage 272 formed between large drawn portion 260 of upstream inner baffle 206 and top wall 238 of upstream outer shell 202, and providing a flow path forcing exhaust against top wall 238 of upstream outer shell 202, enhancing cooling of the exhaust.

Large drawn portion 264 of downstream inner baffle 208 is identical to large drawn portion 260 of upstream inner baffle 206. Large drawn portion 264 extends axially downwardly toward bottom wall 244 of downstream outer shell 204 and divides the volume of downstream expansion chamber 214 into first and second sections 274 and 276, allowing for more expansion and contraction of exhaust in downstream expansion chamber 214. Sections 274 and 276 are joined by a smaller area connection passage 275 formed between large drawn portion 264 of downstream inner baffle 208 and lower wall 244 of downstream outer shell 204.

Upstream inner baffle 206 has an auxiliary drawn portion 280, FIGS. 13, 14, 16, laterally offset from main chamber 216 and from each of subchambers 218 and 220. Upstream inner baffle 206 has a second set of one or more slots or apertures 282, FIGS. 14, 16, laterally offset from auxiliary drawn portion 280 and from main chamber 216 and from each of subchambers 218 and 220. Downstream inner baffle 208 has an auxiliary drawn portion 284, FIGS. 12, 13, 14, 16, laterally offset from main chamber 216 and from each of subchambers 218 and 220. Downstream inner baffle 208 has second set of one or more slots or apertures 286 laterally offset from auxiliary drawn portion 284 and from main chamber 216 and from each of subchambers 218 and 220. Auxiliary drawn portion 284, FIG. 12, of downstream inner baffle 208 mates with upstream inner baffle 206 to define a first section 288 of a bypass chamber 290, FIG. 16. Auxiliary drawn portion 280 of upstream inner baffle 206 mates with downstream inner baffle 208 to define a second section 292, FIGS. 13, 16, of the bypass chamber. First and second sections 288 and 292 of the bypass chamber are partially laterally overlapped as shown at 291 in FIGS. 14 and 16, and are of substantially smaller cross-sectional area than the cross-sectional area of the above noted expansion chambers. Exhaust from upstream expansion chamber 210 thus has an alternate bypass flow path through the set of apertures 282 in upstream inner baffle 206 into first section 288 of the bypass chamber then through the partially laterally overlapped portions 291 of the bypass chamber into second section 292 of the bypass chamber then through the set of apertures 286 in downstream inner baffle 208 into downstream expansion chamber 214, bypassing inner expansion chamber 212 and lowering backpressure.

In the orientation of FIG. 12, upstream outer shell 202, upstream inner baffle 206, downstream inner baffle 208 and downstream outer shell 204 are vertically axially aligned. Exhaust flows from upstream expansion chamber 210 axially downwardly through the set of apertures 222 into subchamber 218 and then turns laterally rearwardly into main chamber 216 and then flows laterally leftwardly through main chamber 216 and then turns axially forwardly into subchamber 220 and then flows axially downwardly through the set of apertures 224 into lower expansion chamber 214. A small portion of the exhaust from upper expansion chamber 210 flows axially downwardly through the set of apertures 282 in upstream inner baffle 206 into first section 288 of bypass chamber 290 and then flows laterally rightwardly through the bypass chamber including the overlap at 291 into second section 292 of the bypass chamber and then flows axially downwardly through the set of apertures 286 in downstream inner baffle 208 into downstream expansion chamber 214. In the orientation of FIG. 12, the first and second sets of apertures 222 and 282 of upstream inner baffle 206 are laterally diagonally spaced, the set of apertures 222 being front right, and the set of apertures 282 being back left. Drawn portions 262 and 280 of upstream inner baffle 206 are laterally diagonally spaced, drawn portion 262 being front left, and drawn portion 280 being back right. The sets of apertures 224 and 286 of downstream inner baffle 208 are laterally diagonally spaced, the set of apertures 224 being front left, and the set of apertures 286 being back right. Drawn portions 266 and 284 of downstream inner baffle 208 are laterally diagonally spaced, drawn portion 266 being front right, and drawn portion 284 being back left. The components are preferably held together by providing downstream outer shell 204 with an upper perimeter lip 296, FIGS. 13, 18, crimped around the outer edges of upstream outer shell 202, upstream inner baffle 206 and downstream inner baffle 208, FIGS. 18, 8, or by welding such components together.

FIGS. 20 and 21 show implementation of muffler 200 in a lawn tractor 300. The muffler is mounted in the noted vertical orientation of FIG. 12 by bolts 302 attaching slanted top wall 238 of upstream outer shell 202 to an angle bracket 304 mounted by bolts 306 to the tractor frame rails such as 308. The slope of slanted surface 238 sheds debris and grass, which is desirable to prevent accumulation thereof on top of the muffler.

It is recognized that various equivalents, alternatives and modifications are possible within the scope of the appended claims.

What is claimed is:

1. A muffler comprising an upstream outer shell, a downstream outer shell, an upstream inner baffle, and a downstream inner baffle, and having an assembled condition forming in combination an upstream expansion chamber, an inner expansion chamber, and a downstream expansion chamber, said upstream expansion chamber being formed between said upstream outer shell and said upstream inner baffle, said inner expansion chamber being formed between said upstream inner baffle and said downstream inner baffle, said downstream expansion chamber being formed between said downstream inner baffle and said downstream outer shell, wherein said upstream inner baffle and said downstream inner baffle divide said inner expansion chamber therebetween into a main chamber and first and second laterally spaced subchambers, said upstream inner baffle having a set of one or more apertures therethrough, said downstream inner baffle having a set of one or more apertures therethrough, said set of apertures of said upstream inner baffle being laterally offset from said set of apertures of said downstream inner baffle, said set of apertures of said upstream inner baffle being aligned with said first subchamber and communicating exhaust from said upstream expansion chamber through said set of apertures in said upstream inner baffle into said first subchamber, said exhaust turning from said first subchamber and flowing laterally through said main chamber and turning to said second subchamber, said set of apertures of said downstream inner baffle being aligned with said second subchamber and communicating exhaust from said second subchamber through said set of apertures in said downstream inner baffle into said downstream expansion chamber.

2. The invention according to claim 1 wherein said upstream and downstream inner baffles are identical to each other and extend to parallel to each other and rotated 180 degrees relative to each other about an axis perpendicular to said parallel extension.

3. The invention according to claim 1 wherein said upstream outer shell, said upstream inner baffle, said downstream inner baffle, and said downstream outer shell are axially aligned in said assembled condition, and wherein exhaust flows axially through said set of apertures of said upstream inner baffle, and wherein exhaust flows axially through said set of apertures of said downstream inner baffle.

4. The invention according to claim 3 wherein said upstream and downstream inner baffles are identical to each other and extend parallel to each other and rotated 180 degrees relative to each other about an axis perpendicular to said parallel extension, said axis being the axis of said axial alignment of said upstream outer shell, said upstream inner baffle, said downstream inner baffle, and said downstream outer shell.

5. The invention according to claim 1 wherein each of said upstream and downstream inner baffles has a first large drawn portion and a second smaller drawn portion, said first large drawn portions of said upstream and downstream inner baffles mating with each other to define said main chamber, said second smaller drawn portions of said upstream and downstream inner baffles being laterally offset from each other, said second smaller drawn portion of said downstream inner baffle mating with said upstream inner baffle to define said first subchamber, said second smaller drawn portion of said upstream inner baffle mating with said downstream inner baffle to define said second subchamber.

6. The invention according to claim 5 wherein:

said set of apertures of said upstream inner baffle is:

aligned with said second smaller drawn portion of said downstream inner baffle;

laterally offset from said second smaller drawn portion of said upstream inner baffle;

laterally offset from said first large drawn portion of said upstream inner baffle;

said set of apertures of said downstream inner baffle is:

aligned with said second smaller drawn portion of said upstream inner baffle;

laterally offset from said second smaller drawn portion of said downstream inner baffle;

laterally offset from said first large drawn portion of said downstream inner baffle.

7. The invention according to claim 5 wherein said first large drawn portion of said upstream inner baffle extends toward said upstream outer shell and divides the volume of said upstream expansion chamber into first and second sections allowing for more expansion and contraction of exhaust in said upstream expansion chamber, said first section of said upstream expansion chamber having an inlet receiving exhaust, said second section of said upstream expansion chamber discharging exhaust to said set of apertures of said upstream inner baffle, said first and second sections of said upstream expansion chamber being joined by a smaller area connection passage formed between said first large drawn portion of said upstream inner baffle and said upstream outer shell and providing a flow path forcing exhaust against said upstream outer shell enhancing cooling of the exhaust.

8. The invention according to claim 7 wherein said first large drawn portion of said downstream inner baffle extends toward said downstream outer shell and divides the volume of said downstream expansion chamber into first and second sections allowing for more expansion and contraction of exhaust in said downstream expansion chamber, said first section of said downstream expansion chamber having an inlet receiving exhaust from said set of apertures of said downstream inner baffle, said second section of said downstream expansion chamber having an outlet discharging exhaust, said first and second sections of said downstream expansion chamber being joined by a smaller area connection passage formed between said first large drawn portion of said downstream inner baffle and said downstream outer shell.

9. The invention according to claim 7 wherein said first large drawn portion of said downstream inner baffle is identical to said first large drawn portion of said upstream inner baffle.

10. The invention according to claim 1 wherein:

said upstream inner baffle has an auxiliary drawn portion laterally offset from said main chamber and from each of said first and second subchambers;

said upstream inner baffle has a second set of one or more apertures laterally offset from said auxiliary drawn portion of said upstream inner baffle and from said main chamber and from each of said first and second subchambers;

said downstream inner baffle has an auxiliary drawn portion laterally offset from said main chamber and from each of said first and second subchambers;

said downstream inner baffle has a second set of one or more apertures laterally offset from said auxiliary drawn portion of said downstream inner baffle and from said main chamber and from each of said first and second subchambers;

said auxiliary portion of said downstream inner baffle mates with said upstream inner baffle to define a first section of a bypass chamber;

said auxiliary drawn portion of said upstream inner baffle mates with said downstream inner baffle to define a second section of said bypass chamber;

said first and second sections of said bypass chamber have partially laterally overlapped portions and are of substantially smaller cross-sectional area than the cross-sectional area of said expansion chambers;

such that exhaust from said upstream expansion chamber has an alternate bypass flow path through said second set of apertures in said upstream inner baffle into said first section of said bypass chamber then through said partially laterally overlapped portions of said first and second sections of said bypass chamber into said second section of said bypass chamber then through said second set of apertures in said downstream inner baffle into said downstream expansion chamber, bypassing said inner expansion chamber and lowering backpressure.

11. The invention according to claim 1 wherein said upstream outer shell, said upstream inner baffle, said downstream inner baffle, and said downstream outer shell are axially aligned along a vertical axis on a lawn tractor, and wherein said upstream outer shell has an upper surface sloped diagonally along a slope relative to said vertical axis to shed grass and debris.

12. The invention according claim 11 wherein each of said upstream and downstream inner baffles has a first large drawn portion and a second smaller drawn portion, said first large drawn portions of said upstream and downstream inner baffles mating with each other to define said main chamber, said second smaller drawn portions of said upstream and downstream inner baffles being laterally offset from each other, said second smaller drawn portion of said downstream inner baffle mating with said upstream inner baffle to define said first subchamber, said second smaller drawn portion of said upstream inner baffle mating with said downstream inner baffle to define said second subchamber, and wherein the lower portion of said slanted upper surface of said upstream outer shell is above said first and second subchambers.

13. The invention according to claim 12 wherein said first large drawn portion of said upstream inner baffle extends toward said upstream outer shell and divides the volume of said upstream expansion chamber into first and second sections allowing for more expansion and contraction of exhaust in said upstream expansion chamber, said first section of said upstream expansion chamber having an inlet receiving exhaust, said second section of said upstream expansion chamber discharging exhaust to said set of apertures of said upstream inner baffle, said first and second sections of said upstream expansion chamber being joined by a smaller area connection passage formed between said first large drawn portion of said upstream inner baffle and said upstream outer shell and providing a flow path forcing exhaust against said upstream outer shell enhancing cooling of the exhaust, wherein the upper portion of said slanted upper surface of said upstream outer shell is above said first section of said upstream expansion chamber, and the lower portion of said slanted upper surface of said upstream outer shell is above said second section of said upstream expansion chamber.

14. A muffler comprising an upstream outer shell, a downstream outer shell, an upstream inner baffle, and a downstream inner baffle having an axially aligned assembled condition forming in combination an upstream expansion chamber, an inner expansion chamber, a downstream expansion chamber, and a bypass chamber, said upstream expansion chamber being formed between said upstream outer shell and said upstream inner baffle, said inner expansion chamber being formed between said upstream inner baffle and said downstream inner baffle and having a laterally leftward flow direction therethrough, said downstream expansion chamber being formed between said downstream inner baffle and said downstream outer shell, said bypass chamber being formed between said upstream inner baffle and said downstream inner baffle and having a laterally rightward flow direction therethrough, said inner expansion chamber and said bypass chamber being laterally offset from each other and axially aligned with each of said upstream and downstream expansion chambers, wherein each of said upstream and downstream inner baffles extends laterally left to right and front to back, said upstream inner baffle has a first set of one or more apertures therethrough and a second set of one or more apertures therethrough, said first set of apertures through said upstream inner baffle being laterally diagonally offset from said second set of apertures through said upstream inner baffle, said downstream inner baffle has a first set of one or more apertures therethrough and a second set of one or more apertures therethrough, said first set of apertures through said downstream inner baffle being laterally diagonally offset from said second set of apertures through said downstream inner baffle, said first set of apertures through said downstream inner baffle being laterally lefwardly offset from said first set of apertures through said upstream inner baffle, said second set of apertures through said downstream inner baffle being rightwardly offset from said second set of apertures through said upstream inner baffle.

15. The invention according to claim 14 wherein said upstream inner baffle and said downstream inner baffle divide said inner expansion chamber therebetween into a main chamber and first and second subchambers, said second subchamber being spaced laterally leftwardly of said first subchamber, exhaust flowing laterally leftwardly in said main chamber, exhaust flowing axially downwardly from said upper expansion chamber through said first set of apertures in said upstream inner baffle and then axially downwardly into said first subchamber and then laterally rearwardly into said main chamber and then laterally leftwardly through said main chamber and then laterally forwardly into said second subchamber and then axially downwardly from said second subchamber through said first set of apertures in said downstream inner baffle axially downwardly into said downstream expansion chamber, said upstream inner baffle has a bypass section laterally offset rearwardly from said main chamber and said first subchamber and axially aligned with said second set of apertures in said downstream inner baffle, said downstream inner baffle has a bypass section laterally rearwardly offset from said main chamber and said second subchamber and axially aligned with said second set of apertures in said upstream inner baffle, said bypass section of said downstream inner baffle mating with said upstream inner baffle to define a first section of a bypass chamber, said bypass section of said upstream inner baffle mating with said downstream inner baffle to define a second section of said bypass chamber, said first and second sections of said bypass chamber being partially laterally overlapped left to right and of substantially smaller cross-sectional area than said expansion chambers, exhaust flowing from said upper expansion chamber axially downwardly through said second set of apertures in said upstream inner baffle into said first section of said bypass chamber then laterally rightwardly through the overlapping of said first and second sections of said bypass chamber and then laterally rightwardly into said second section of said bypass chamber then axially downwardly through said second set of apertures in said downstream inner baffle into said lower expansion chamber.

16. The invention according to claim 14 wherein each of said upstream and downstream inner baffles has a first large drawn portion and a second smaller drawn portion, said first large drawn portions of said upstream and downstream inner baffles mating with each other to define said main chamber, said second smaller drawn portions of said upstream and downstream inner baffles being laterally offset from each other, said second smaller drawn portion of said downstream inner baffle mating with said upstream inner baffle to define said first subchamber, said second smaller drawn portion of said upstream inner baffle mating with said downstream inner baffle to define said second subchamber, and wherein said first large drawn portion of said upstream inner baffle extends toward said upstream outer shell and divides the volume of said upstream expansion chamber into first and second sections allowing for more expansion and contraction of exhaust in said upstream expansion chamber, said first section of said upstream expansion chamber having an inlet receiving exhaust, said second section of said upstream expansion chamber discharging exhaust to said set of apertures of said upstream inner baffle, said first and second sections of said upstream expansion chamber being joined by a smaller area connection passage formed between said first large drawn portion of said upstream inner baffle and said upstream outer shell and providing a flow path forcing exhaust against said upstream outer shell enhancing cooling of the exhaust.

* * * * *